US010485726B2

(12) United States Patent
O'Keefe

(10) Patent No.: US 10,485,726 B2
(45) Date of Patent: Nov. 26, 2019

(54) SWIVELABLE MASSAGE DEVICE

(71) Applicant: The Nexxbar Equipment Inc., Mount Pearl (CA)

(72) Inventor: Ross P. O'Keefe, Mount Pearl (CA)

( * ) Notice: Subject to any disclaimer, the term of this patent is extended or adjusted under 35 U.S.C. 154(b) by 605 days.

(21) Appl. No.: 15/165,742

(22) Filed: May 26, 2016

(65) Prior Publication Data

US 2017/0340511 A1 Nov. 30, 2017

(51) Int. Cl.
*A61H 15/00* (2006.01)
*A61H 11/00* (2006.01)

(52) U.S. Cl.
CPC ..... *A61H 15/00* (2013.01); *A61H 2011/005* (2013.01); *A61H 2015/0014* (2013.01); *A61H 2201/0153* (2013.01); *A61H 2201/165* (2013.01); *A61H 2201/1635* (2013.01); *A61H 2201/1671* (2013.01); *A61H 2201/1685* (2013.01); *A61H 2201/1695* (2013.01); *A61H 2205/04* (2013.01); *A61H 2205/062* (2013.01); *A61H 2205/081* (2013.01); *A61H 2205/10* (2013.01)

(58) Field of Classification Search
CPC ..... A61H 15/00; A61H 2201/1685; A61H 2201/0153; A61H 2011/005; A61H 2205/10; A61H 2201/1695; A61H 2201/1635; A61H 2201/1671; A61H 2201/165; A61H 2205/081; A61H 2015/0014; A61H 2205/04; A61H 2205/062
See application file for complete search history.

(56) References Cited

U.S. PATENT DOCUMENTS

| | | | | |
|---|---|---|---|---|
| 4,648,387 | A | 3/1987 | Simmons | |
| 5,364,338 | A | 11/1994 | Terashima | |
| 5,545,456 | A | 8/1996 | Suida | |
| 6,849,055 | B1 | 2/2005 | Williams | |
| 9,005,146 | B2 | 4/2015 | Phillips | |
| 9,107,795 | B2 | 8/2015 | Faussett | |
| 2012/0065557 | A1* | 3/2012 | Phillips | A61H 15/0092 601/99 |
| 2013/0096472 | A1 | 4/2013 | Bertram et al. | |
| 2014/0276280 | A1 | 9/2014 | Oller, Jr. | |
| 2015/0011921 | A1 | 1/2015 | Sidhu | |
| 2015/0224016 | A1* | 8/2015 | Holland | A61H 15/00 601/131 |
| 2016/0008213 | A1 | 1/2016 | Cheng | |
| 2016/0081873 | A1* | 3/2016 | Sims | A61H 15/0092 601/119 |
| 2016/0296415 | A1* | 10/2016 | Cross | A61H 15/0092 |
| 2017/0216131 | A1* | 8/2017 | Leier | A61H 15/0092 |
| 2018/0185692 | A1* | 7/2018 | Wailes | A63B 21/4015 |

FOREIGN PATENT DOCUMENTS

| | | | | |
|---|---|---|---|---|
| GB | 310684 | * | 5/1929 | A61H 15/00 |

* cited by examiner

*Primary Examiner* — Quang D Thanh

(57) ABSTRACT

A massage device includes a massage roller that extends lengthwise along an axis from a first end to a second end, opposite said first end, a grip extending from the first end, and a flexible sling extending from the second end and swivelably mounted to the second end. The sling includes an elbow harness for receiving a user's elbow. The massage roller may be urged and rolled against the first side of a user's body by holding the grip and applying a force on the elbow harness with the elbow on the opposite side of the user's body, while the massage roller is allowed to rotate about the axis without twisting the sling.

16 Claims, 7 Drawing Sheets

SWIVELABLE MASSAGE DEVICE

TECHNICAL FIELD

This relates to a massage device for massaging parts of the human body, in particular, neck, back and shoulders.

BACKGROUND

Massage techniques applicable to the human body are well-known for treating soft tissue and as preventative therapy. Conventionally, massage can be achieved by use of hands or fingers. For self-massage, it may be difficult for a person to access his or her back and shoulders with his or her own hands or fingers, and a massaging device may be used.

Many existing massaging devices exist as elongated bars with a handle at each opposite end. These are designed to apply pressure to various points on a user's body by way of the user grasping the handles at each end of the device with the user's hands.

However, such a design may not permit access to particular areas of the body or the ability to apply intended pressure at a desired angle or magnitude, depending on the dimensions of the user's body, and the user's flexibility and physiology. The device may not be manipulable with the desired level of control.

Accordingly, there is a need for a massage device that provides access to a user's neck, shoulder and back by manipulating an accessible part of the user's own body.

SUMMARY

According to an aspect, there is provided a massage device including a lengthwise extending massage roller. The massage roller extends along an axis from a first end to a second end, opposite the first end. The massage device also includes a grip extending from the first end and a flexible sling extending from the second end, and swivelably mounted thereto, the sling having an elbow harness for receiving an elbow of a user. The massage roller may be urged against a shoulder and rolled thereon on a first side of a user's body by holding the grip and applying a force on the elbow harness with an elbow on a second opposite side of the user's body, while the massage roller is allowed to rotate about the axis without twisting the sling.

According to another aspect, there is provided a method of operating a massage device. The method includes providing a lengthwise extending massage roller extending along an axis from a first end to a second end, opposite said first end, and a flexible sling that is swivelably mounted to the second end, and transmitting force through said massage roller to a shoulder on a first side of a body of a user from a force applied to said flexible sling through an elbow harness that receives an elbow of the user, the elbow on an opposite side of the user's body.

Other features will become apparent from the drawings in conjunction with the following description.

BRIEF DESCRIPTION OF THE DRAWINGS

In the figures which illustrate example embodiments.

For convenience, like reference numerals in the description refer to like elements in the drawings.

DETAILED DESCRIPTION

Figure 1:
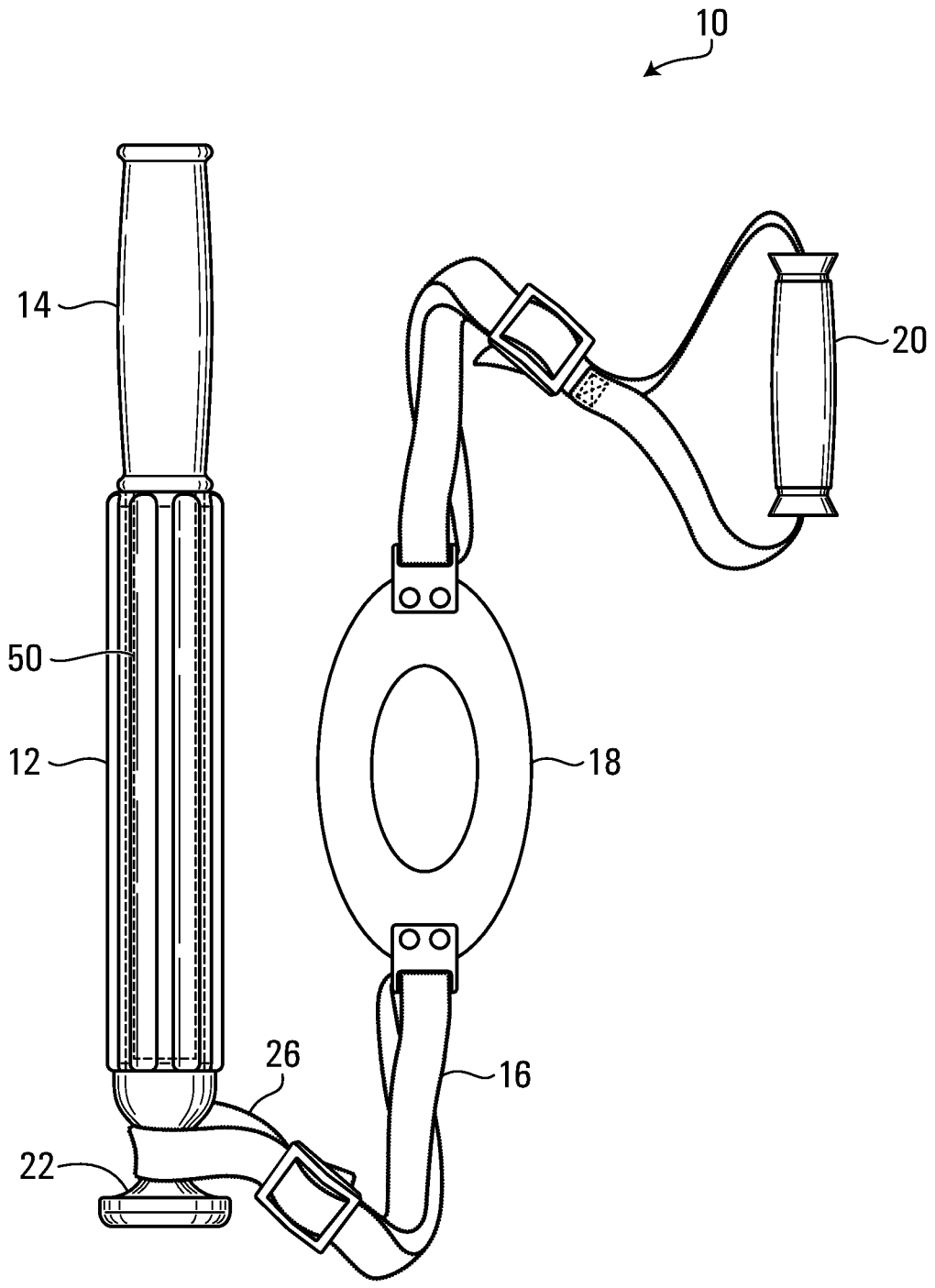
FIG. 1 is a perspective view of a massage device, exemplary of an embodiment.

FIG. 1 is a perspective view of a massage device 10, exemplary of an embodiment. Massage device 10 includes a massage roller 12 that is generally cylindrical in shape and extends lengthwise. A grip 14 extends from a first end of rod 50 retractably mounted between a first end of massage roller 12 and grip 14. A flexible sling 16 extends from a second end of massage roller 12, opposite the first end.

Grip 14 may be shaped to be grasped by a hand of a user, and may be formed of a material with a relatively high coefficient of friction, such as rubber or appropriate natural or synthetic polymer, graspable by the user. In some embodiments, grip 14 may be rigidly attached to rod 50.

Massage roller 12 includes hollow cavity, sized to receive at least part of the length of rod 50. As such, rod 50 may telescope in or out of massage roller 12. FIG. 1 illustrates rod 50 generally retracted within massage roller 12. In extension, rod 50 exits massage roller 12, as described in further detail below with reference to FIG. 5.

Rod 50 may be locked to a desired extension, and may be connected to massage roller 12, for example by way of a twist lock (not shown). A twist lock may include a male thread threaded with a female thread that is disposed in a second end of rod 50, opposite the first end. A lock bushing may be situated between a head of the male thread and the second end of rod 50. The lock bushing may be made of a compressible material, for example, rubber. The lock bushing may be compressed axially by twisting the complementary threads, resulting in expansion radially. The radial expansion of the lock bushing may secure with friction the position of rod 50, both axially and radially relative to massage roller 12. Other techniques for locking rod 50 in a desired position, for example a lever lock, will be apparent to a person skilled in the art. Furthermore, other techniques for preventing rod 50 from radial movement relative to massage roller 12 will be apparent to a person skilled in the art.

At the second end of massage roller 12, opposite the first end, a groove 22 circumscribes the second end of massage roller 12, forming a sheave having a core and axially spaced-apart flanges. Groove 22 may receive flexible sling 16. Groove 22 may be u-shaped in cross-section, and the valley of the u-shaped cross-section decreasing in diameter.

Flexible sling 16 is swivelably mounted to massage roller 12 by a loop 26 at an end of sling 16 encircling groove 22, mounting flexible sling 16 to massage roller 12, as shown in FIG. 1.

Loop 26 may be adjustable, and made of a flexible fabric or polymer. Loop 26 is received within groove 22 of the sheave and can freely rotate relative to massage roller 12, and in particular relative to an axis extending lengthwise along massage roller 12. Flanges of the sheave are greater in diameter than the core of the sheave, and thus restrain loop 26 from exiting groove 22 during use. In some embodiments, one or more flanges of the sheave have a diameter that may be greater than the diameter of massage roller 12.

Flexible sling 16 includes an elbow harness that can receive an elbow of a user. In some embodiments, an elbow harness may be elastic. As shown in FIG. 1, an elbow harness is formed from an o-shaped fabric 18, which may be, for example, leather or polymer. In some embodiments, o-shaped fabric 18 may be generally circular in shape with dimensions, for example, of an outer diameter of between 10 cm and 20 cm and an inner diameter of between 2 cm and 10 cm, or may be generally elliptical in shape with one or more axes of symmetry and a minor axis of between 10 cm and 20 cm that is shorter in length than a major axis of between 10 cm and 20 cm. In some embodiments, o-shaped fabric 18 may be between 10 cm and 50 cm along a length of flexible sling 16.

Flexible sling 16 also includes a handle 20 extending from o-shaped fabric 18. Handle 20 is configured to be grasped by a hand of a user to urge o-shaped fabric 18 against the user's elbow. In some embodiments, handle 20 may be between 50 cm and 150 cm along a length of flexible sling 16.

Figure 2:
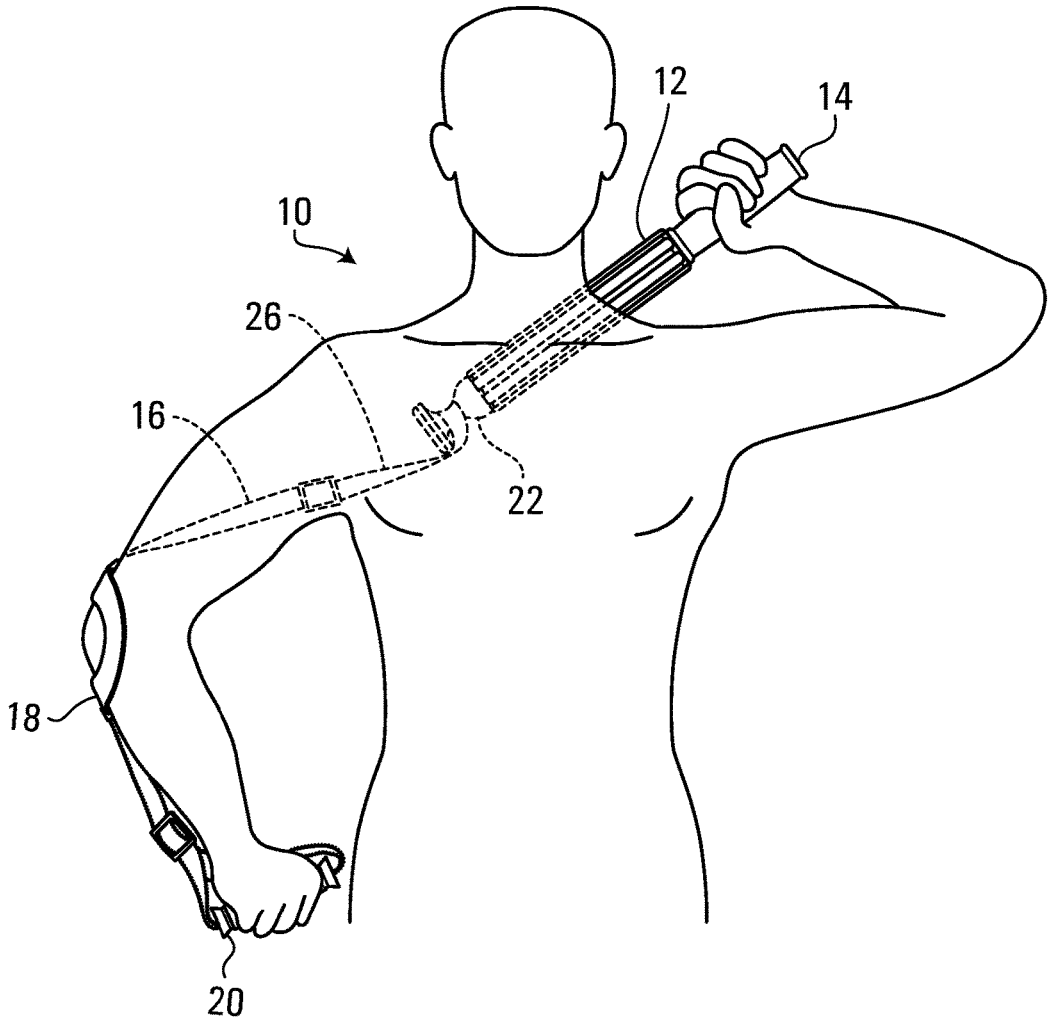
FIG. 2 is a perspective view of the massage device of FIG. 1 in use, viewed from the front of a user.
Figure 3:
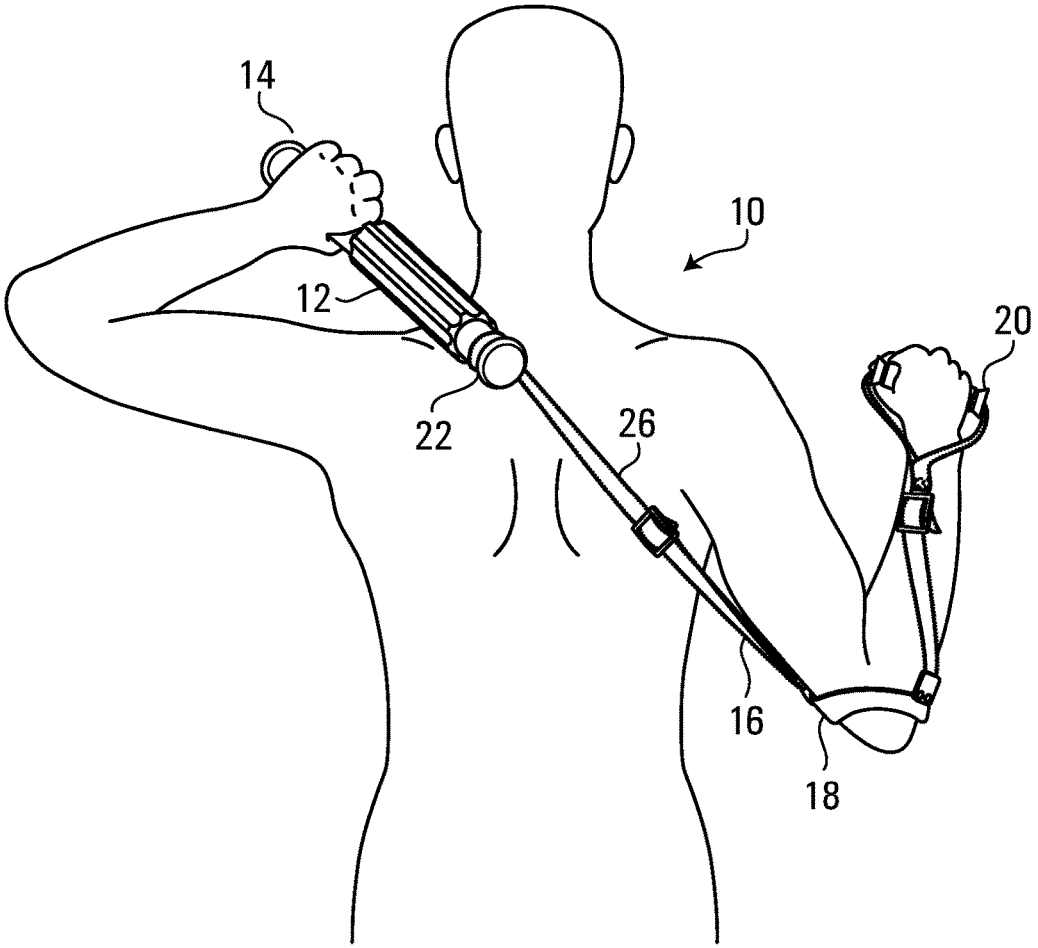
FIG. 3 is a perspective view of the massage device of FIG. 1 in use, viewed from the back of the user in FIG. 2.

FIG. 2 is a perspective view of massage device 10 of FIG. 1 in use, viewed from the front of a user. FIG. 3 is a perspective view of massage device 10 of FIG. 1 in use, viewed from the back of the user in FIG. 2.

In use, massage roller 12 may be urged against and rolled on a user's shoulder on a first side of the user's body, shown as the user's left side in FIGS. 2 and 3, by holding grip 14, shown with the user's left hand in FIGS. 2 and 3, and applying a force on o-shaped fabric 18 with an elbow on a second opposite side of the user's body, shown as the user's right side in FIGS. 2 and 3. By rotating grip 14 with the user's left hand, rotating force is transferred to massage roller 12, which is allowed to freely rotate along the user's body about an axis extending lengthwise from a first end to an opposite second end of massage roller 12 without significantly twisting flexible sling 16, since during rotation, the core of the sheave rotates and allows massage roller 12 to rotate while loop 26 of sling 16 remains in groove 22.

The flanges of the sheave allow lateral or axial forces to be applied to massage roller 12 by sling 16 without loop 26 of sling 16 leaving groove 22.

Force may also be optionally applied to handle 20, grasped by a user's right hand as shown in FIGS. 2 and 3, to urge o-shaped fabric 18 against the user's right elbow during use.

Since flexible sling 16 does not twist significantly during use as described above, by holding grip 14 and manipulating flexible sling 16, a user may be able to apply desired force at a desired angle with massage roller 12 on a portion of the user's body.

The use described above is non-limiting, and massage device 10 may be used in a variety of configurations on different body parts of a user, constrained only by a user's physiological dimensions. By way of example, a user may use massage device 10 by holding grip 14 with the user's left hand, applying a force on o-shaped fabric 18 with the user's right elbow, and grasping handle 20 with a user's right hand to urge massage roller 12 against a user's calf.

In an alternate use, flexible sling 16 may be sat upon by a user to use the leverage from the user's body weight to urge massage roller 12 against the user's body, which may allow for an extended range of contact and leverage for massage roller 12, for example, to the user's upper-to-mid back. In this use, the user's elbow may or may not be received in o-shaped fabric 18, and the user grasps handle 20.

Figure 4:
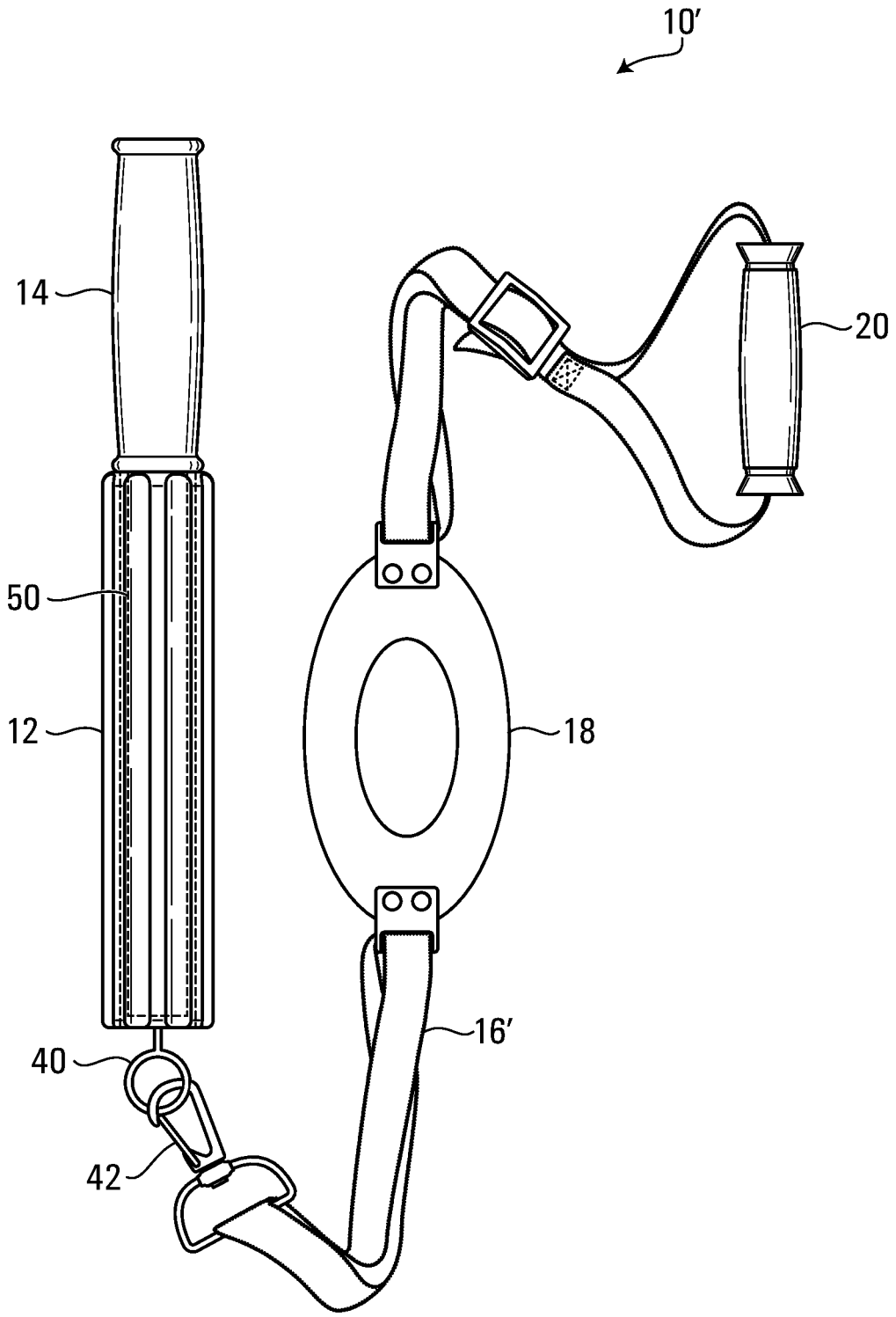
FIG. 4 is a perspective view of a massage device with a swivel and a clip connecting a flexible sling to a massage roller, exemplary of an embodiment.

FIG. 4 is a perspective view of a massage device 10' with a swivel 40 and a clip 42 connecting a flexible sling 16' to a massage roller 12, exemplary of an embodiment. In the alternative embodiment massage device 10' shown in FIG. 4, flexible sling 16' is swivelably mounted to massage roller 12 by way of clip 42 at an end of flexible sling 16' (instead of loop 26) and connected to swivel 40 that extends from a second end of massage roller 12, opposite a first end of massage roller 12 from which rod 50 and grip 14 extend.

In the embodiment illustrated in FIG. 4, swivel 40 is a bolt with a generally circular loop at one end. The bolt end, at a second end opposite the first end, may be inserted through a hole in the second end of massage roller 12 and secured against massage roller 12 by a nut, with a diameter larger than the diameter of the hole in the second end of massage roller 12, threaded on the bolt end (not shown), and swivel 40 may freely rotate about an axis extending lengthwise from the first end to the second end of massage roller 12.

In some embodiments, swivel 40 may be a swivel eye bolt or a hoist ring attached to massage roller 12. A threaded end may be bolted or screwed into the second end of massage roller 12, and a generally circular loop is attached to the threaded end between a pair of bushing flanges, the generally circular loop freely rotatable about an axis extending lengthwise along the threaded end and lengthwise from the first end to the second end of massage roller 12.

In some embodiments, swivel 40 may be attached to massage roller 12 at one end by riding the inner race of a ball bearing element, while an outer race of the ball bearing element is fitted to the second end of massage roller 12, and at a second end of swivel 40, opposite the first end, a generally circular loop freely rotates about an axis extending lengthwise from the first end to the second end of massage roller 12.

In use, massage roller 12 is allowed to rotate about the axis without significantly twisting flexible sling 16g.

Figure 5:
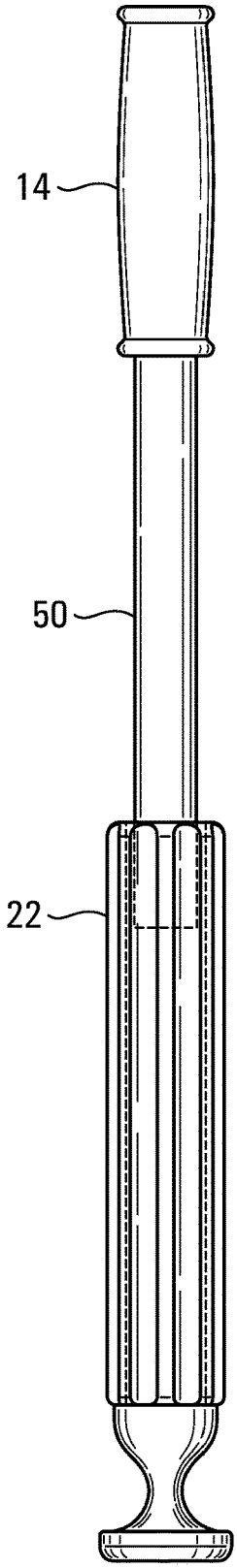
FIG. 5 is a perspective view of the rod, massage roller and grip of FIG. 1, the rod in an extended position.

FIG. 5 is a perspective view of the rod 50, massage roller 12 and grip 14 of FIG. 1, rod 50 in an extended position. In this position, rod 50 extends the reach of massage roller 12 from grip 14, which may allow for use by users of various dimensions or a larger size, and in alternate configurations to access different areas of a user's body.

FIGS. 6A to 6F are partial perspective views of different outer surfaces for a massage roller, exemplary of embodiments. Massage roller 12 is illustrated in FIGS. 1-5 with the outer surface shown in FIG. 6A, which is generally cylindrical in shape, with longitudinal ribs extending along the length of massage roller 12.

Figure 6A:
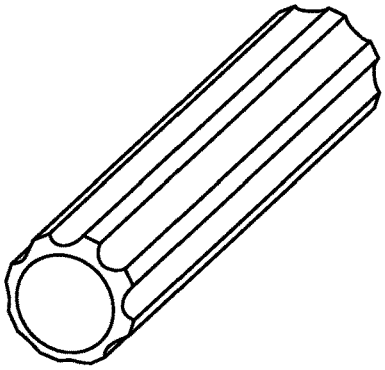
FIGS. 6A to 6F are partial perspective views of different outer surfaces for a massage roller, exemplary of embodiments.
Figure 6B:
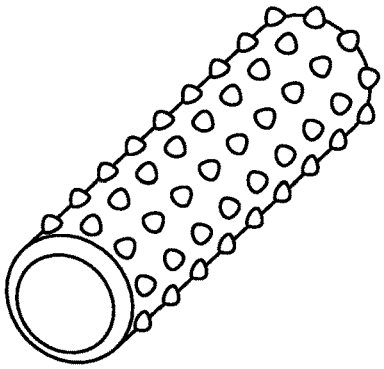

FIG. 6B illustrates an embodiment of a massage roller having a plurality of surfaces projecting radially outwardly from an outer surface of the massage roller.

Figure 6C:
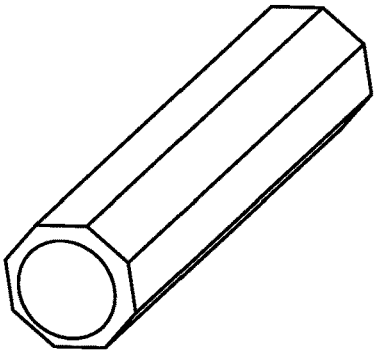

FIG. 6C illustrates an embodiment of a massage roller that is generally octagonally prismatic in shape.

Figure 6D:
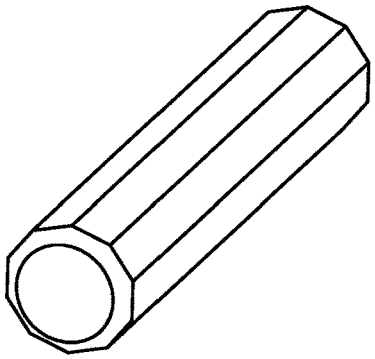

FIG. 6D illustrates an embodiment of a massage roller that is generally decagonally prismatic in shape.

Figure 6E:
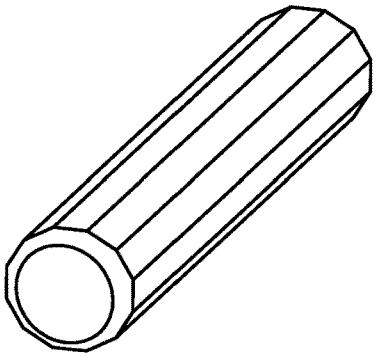

FIG. 6E illustrates an embodiment of a massage roller that is generally dodecagonally prismatic in shape.

Figure 6F:
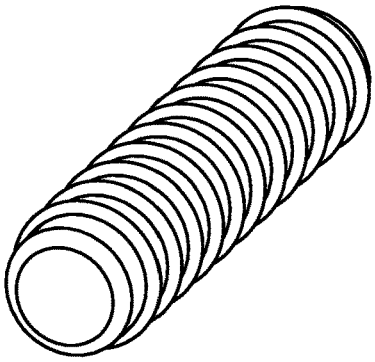

FIG. 6F illustrates an embodiment of a massage roller that is generally cylindrical in shape with radial ribs extending around a circumference of the massage roller.

The examples illustrated in FIGS. 6A-6F are non-limiting and may be combined on a segment of massage roller 12, or modified on the basis of depth, texture and density of material across segments of massage roller 12. Various configurations of a massage roller may create different surfaces that are in contact with a user's body part, and may result in differing forces being applied to a user's body.

Figure 7:
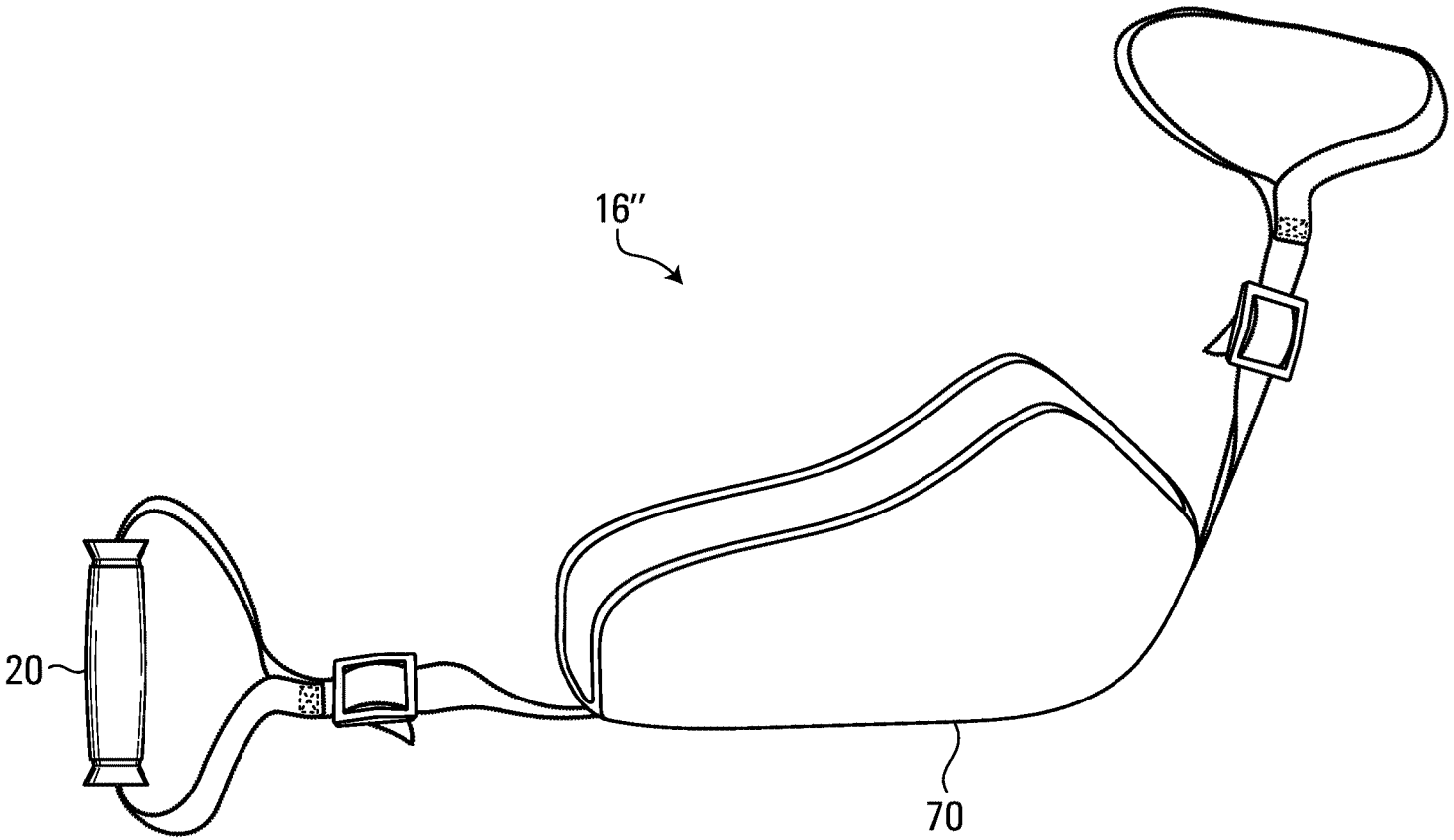
FIG. 7 is a perspective view of a flexible sling, exemplary of an embodiment.

FIG. 7 is a perspective view of a flexible sling 16", exemplary of an embodiment. In this alternative embodiment, an elbow harness for receiving an elbow of a user may be an elbow pad 70, instead of o-shaped fabric 18.

Of course, the above described embodiments are intended to be illustrative only and in no way limiting. The described embodiments are susceptible to many modifications of form, arrangement of parts, details and order of operation. The invention is intended to encompass all such modification within its scope, as defined by the claims.

What is claimed is:

1. A massage device, comprising:

a lengthwise extending massage roller extending along an axis from a first end to a second end, opposite said first end;

a grip extending from said first end;

a massage surface on said massage roller, positioned between said grip and said second end;

wherein said grip allows rotation of said massage surface about said axis, by rotating said grip about said axis;

a groove proximate said second end;

a flexible sling comprising an elbow harness and a loop at an end of said flexible sling to encircle said groove, mounting said flexible sling to said massage roller;

wherein said flexible sling is dimensioned and mounted to said groove to allow said massage roller to be urged against a shoulder of a user on a first side of said user's body by holding said grip and applying a force on said elbow harness with an elbow on a second opposite side of said user's body, while said massage surface is rotated about said axis by rotating said grip about said axis, without twisting said flexible sling.

2. The massage device of claim 1, wherein said flexible sling further comprises a handle extending from said elbow harness, configured to be grasped by a hand of said user to urge said elbow harness against said elbow.

3. The massage device of claim 1, wherein said elbow harness comprises an o-shaped fabric.

4. The message device of claim 3, wherein said fabric comprises leather or a polymer.

5. The massage device of claim 1, wherein said elbow harness is between 10 cm and 50 cm along a length of said flexible sling.

6. The massage device of claim 2, wherein said handle is between 50 cm and 150 cm along a length of said flexible sling.

7. The massage device of claim 1, wherein said elbow harness is elastic.

8. The massage device of claim 1, wherein said massage roller has a generally cylindrical shape.

9. The massage device of claim 1, wherein said massage roller has a generally prismatic shape that is octagonal, decagonal or dodecagonal.

10. The massage device of claim 1, further comprising a plurality of surfaces projecting radially outwardly from an outer surface of said massage roller.

11. The massage device of claim 1, wherein said massage surface comprises a plurality of ribs extending around a circumference of said massage roller.

12. The massage device of claim 1, further comprising a plurality of ribs extending longitudinally along said massage surface of said massage roller.

13. The massage device of claim 1, further comprising a rod retractably mounted between said massage roller and said grip.

14. The massage device of claim 1, wherein said grip is rigidly connected to said massage roller.

15. A massage device, comprising:

a lengthwise extending massage roller, said massage roller having a grip at one free end thereof, and a sheave formed proximate a second end of said massage roller;

a massaging surface on said massage roller;

a flexible sling, having a loop at one end, and a handle proximate a distal end of said flexible sling;

said loop received within said sheave to allow application of a downward force on said massage roller through said sheave, and concurrent rotation of said massage roller about its central axis within said loop by rotating said grip about said central axis.

16. The massaging device of claim 15, wherein said flexible sling further comprises an elbow harness positioned between said handle and said loop.

* * * * *